US005287145A

United States Patent [19]

Ohtsuka

[11] Patent Number: 5,287,145

[45] Date of Patent: Feb. 15, 1994

[54] PROCESS KIT OF IMAGE FORMING APPARATUS

[75] Inventor: Yoshinori Ohtsuka, Yamatokoriyama, Japan

[73] Assignee: Sharp Kabushiki Kaisha, Osaka, Japan

[21] Appl. No.: 45,623

[22] Filed: Apr. 9, 1993

[30] Foreign Application Priority Data

Apr. 16, 1992 [JP] Japan ..... 4-096378

[51] Int. Cl.[5] ..... G03G 15/00

[52] U.S. Cl. ..... 355/210; 355/221; 355/296; 346/160.1

[58] Field of Search ..... 355/210, 211, 200, 296, 355/221; 346/160.1, 74 L

[56] References Cited

U.S. PATENT DOCUMENTS

| | | | |
|---|---|---|---|
| 4,891,678 | 1/1990 | Ishizu et al. . | |
| 5,028,966 | 7/1991 | Kozuka et al. | 355/210 X |
| 5,047,801 | 9/1991 | Haneda et al. | 355/200 |
| 5,055,876 | 10/1991 | Matsuoka et al. | 355/211 |
| 5,103,261 | 4/1992 | Matsuo et al. | 355/210 |
| 5,181,070 | 1/1993 | Masuda | 355/200 |
| 5,204,713 | 4/1993 | Yamamura | 355/210 |

FOREIGN PATENT DOCUMENTS 61-18181 5/1986 Japan .

*Primary Examiner*—R. L. Moses

*Attorney, Agent, or Firm*—David G. Conlin; George W. Neuner

[57] ABSTRACT

The process kit is mounted on the apparatus main body from above. By the support frame, the photosensitive drum, main charger and cleaning unit are integrally supported to compose the process kit. At both ends of the support frame, handle members made of flexible resin or metal are provided. The handle members are furnished with fixing pawls for fixing the process kit to the mounting position of the apparatus main body by engaging with the fixing recesses provided at the apparatus main body side. When the process kit is lifted, since the both ends are securely supported and are kept in balance by both hands, the support state of the process kit may be always stable. Whether the process kit is installed securely in the mounting position may be judged easily. That is, any user without professional knowledge can accurately and easily install the process kit.

8 Claims, 12 Drawing Sheets

PROCESS KIT OF IMAGE FORMING APPARATUS

BACKGROUND OF THE INVENTION

1. Field of the Invention

The present invention relates to a process kit of image forming apparatus combining a plurality of constituent units such as photosensitive drum and cleaning unit contained in an image forming apparatus such as laser printer of electrostatic transfer type, and more particularly to a process kit mounted on the apparatus main body from above.

2. Description of the Related Art

In the case of an image forming apparatus such as laser printer of electrostatic transfer type, when it is used for a long time, it is necessary to replace the photosensitive drum, and replace or adjust other units, and usually such must be assigned to the serviceman having the professional knowledge.

Recently, by furnishing the apparatus main body with a process kit combining a plurality of constituent units such as photosensitive drum, developing unit and cleaning unit contained in the apparatus, the user of the image forming apparatus can do servicing only by replacing the process kit without asking the serviceman having the professional knowledge.

In such image forming apparatus, the user without professional knowledge can replace the process kit, and hence it is required to do the work as easily as possible.

However, lately, to cope with the trend of smaller size, lighter wight and lower cost of the apparatus, the process kit having the photosensitive drum exposed on the outside is often used. In such process kit, if the photosensitive drum touches the other member when installing the process kit, the surface is easily damaged, and particular attention is needed when mounting the process kit.

Accordingly, in such image forming apparatus, usually, in order that the mounting state can be visually checked by the user when mounting the process kit, and to cope with the thinner trend of the apparatus, the upper part of the apparatus main body is opened, and the process kit is mounted from above the apparatus main body.

Generally, such process kit is provided with a handle member for lifting by the user when mounting. As the handle member to be disposed in the process kit, as disclosed in the Japanese Examined Patent Publication (KOKOKU) No. JP-B2 61-18181 (1986), when the unit for accommodating the toner is assembled in the process kit, a bar shaped handle member extending in the longitudinal direction of the process kit is widely used, which is considered so that the toner may not be shifted to one side when carrying the process kit by holding the handle member, and the handle member is provided in the upper part of the process kit in the process kit of the type for mounting from above the apparatus main body as mentioned above.

The user grips the handle member, lifts the process kit while keeping horizontal in the longitudinal direction, and mounts the process kit on the apparatus main body.

In such conventional constitution, when mounting the process kit, a certain user may hold nearly the middle of the handle member by one hand. However, when the process kit is lifted while keeping horizontal in the longitudinal direction, the supporting state is unstable if the middle of the handle member is supported by one hand, and it is difficult to keep balance as the process kit is heavier and longer. Therefore, when mounting the process kit on the apparatus main body, the balance may be broken, and, for example, the exposed photosensitive drum may be hit against the member of the apparatus main body side, and the photosensitive drum may be damaged. In particular, the supporting position of the handle member is deviated from the middle part, the process kit is installed in an inclined state, and when mounting the process kit the instability increases.

Besides, since the process kit is mounted by the user without professional knowledge, the user cannot judge, after mounting the process kit, if the process kit has been securely installed in the specified mounting position. Hence, without knowing that the process kit has been installed at a position off the specified mounting position, the opened upper part of the apparatus main body may be closed, which may lead to damage of the photosensitive drum or the like.

What is more, when dismounting the process kit and cleaning the constituent members of the image forming apparatus, cleaning members may be provided or prepared separately from the process kit, which is very bothering.

SUMMARY OF THE INVENTION

The invention is devised in the light of the these points, and it is hence a primary object thereof to present a process kit of image forming apparatus capable of mounting the process kit on the main body, mounting the process kit in a well-balanced state, and judging easily whether the process kit has been securely installed in the specified mounting position or not, so that any user without professional knowledge may mount the process kit securely and easily.

It is other object of the invention to make use of a handle member when mounting the process kit, and utilize the handle member also as the cleaning means for other members composing the image forming apparatus.

To solve the problems, the invention presents a process kit of image forming apparatus comprising a bar unit for composing an image forming apparatus, bar unit supporting means for supporting the bar unit horizontally in the longitudinal direction, and a handle member disposed in the bar unit supporting means, so that the process kit may be mounted from above the image forming apparatus main body, which further comprises the following means.

That is, the handle member is provided at both ends of the bar unit supporting means, and position fixing means for fixing the process kit in the specified mounting position of the image forming apparatus main body is provided in the handle member.

The handle member of the invention is detachably on and off the bar unit supporting means, and a cleaning member is provided in this handle member.

In this constitution, the process kit is lifted by the user by gripping the handle member, and is mounted on the image forming apparatus main body from above.

The bar unit of the process kit is supported horizontally in the longitudinal direction by the bar unit supporting means. The handle member is provided at both ends of the bar unit supporting means, and when the user lifts the process kit, as a matter of course, the handle member at both ends is held and lifted by both hands.

When lifting the bar unit while keeping horizontal in the longitudinal direction, it is hard to keep balance if the bar unit is heavy, but the lifted process kit is securely supported at both ends, and kept in balance by both hands, so that the supporting state of the process kit is always stable. Therefore, whoever mounts the process kit, it is possible to manipulate in the state of supporting the process kit in good balance.

Besides, since the process kit is provided with position fixing means, even the user without professional knowledge can easily judge whether the process kit is installed securely in the specified mounting position of the apparatus main body or not.

Moreover, since the position fixing means is provided in the handle member, it is not necessary to touch other members than the handle member when mounting the process kit.

In addition, since the handle member is integrally formed with the cleaning member, it can be dismounted from the bar unit supporting means, and the other constituent members of the image forming apparatus may be cleaned by it. That is, after dismounting the process kit from the image forming apparatus, the handle member may be dismounted from the unit supporting member, and, for example, the discharge wire of corona discharger or the like can be cleaned by the cleaning member.

Further in this invention, the handle member comprises a fixed handle part and a movable handle part opposite to the fixed handle part, and the cleaning member is provided on the mutually opposing surfaces of the fixed handle part and movable handle part.

The handle member has a pawl part, and a hole to be fitted with the pawl part is provided in the bar unit supporting means.

A boss is formed in the handle member, and a boss hole in which the boss is inserted is formed in the bar unit supporting means.

The cleaning member is composed of a material possessing relatively a flexibility.

The cleaning member is composed of felt.

The cleaning member is composed of sponge.

The process kit of the invention is thus composed, and the handle member is disposed at both ends of the bar unit supporting means, and the handle member is also provided with position fixing means for fixing the process kit in the specified mounting position of the image forming apparatus main body.

When lifting the process kit while keeping the bar unit horizontal in the longitudinal direction, it is hard to keep balance if the bar unit is heavy and long, but the lifted process kit is securely supported at both ends, and kept in balance by both hands, so that the supporting state of the process kit is always stable regardless of the operator. Even the user without professional knowledge can judge easily that the process kit is securely installed in the specified mounting position of the apparatus main body. In the process kit mounting procedure, it is not necessary to touch other parts than the handle member.

Therefore, the process kit of the image forming apparatus can be securely and easily installed by the user without professional knowledge.

In addition, since the handle member is integrally formed with the cleaning member, and it can be dismounted from process kit, the other constituent members of the image forming apparatus may be cleaned easily.

BRIEF DESCRIPTION OF THE DRAWINGS

Other and further objects, features, and advantages of the invention will be more explicit from the following detailed description taken with reference to the drawings wherein.

DETAILED DESCRIPTION OF THE INVENTION

Figure 1:
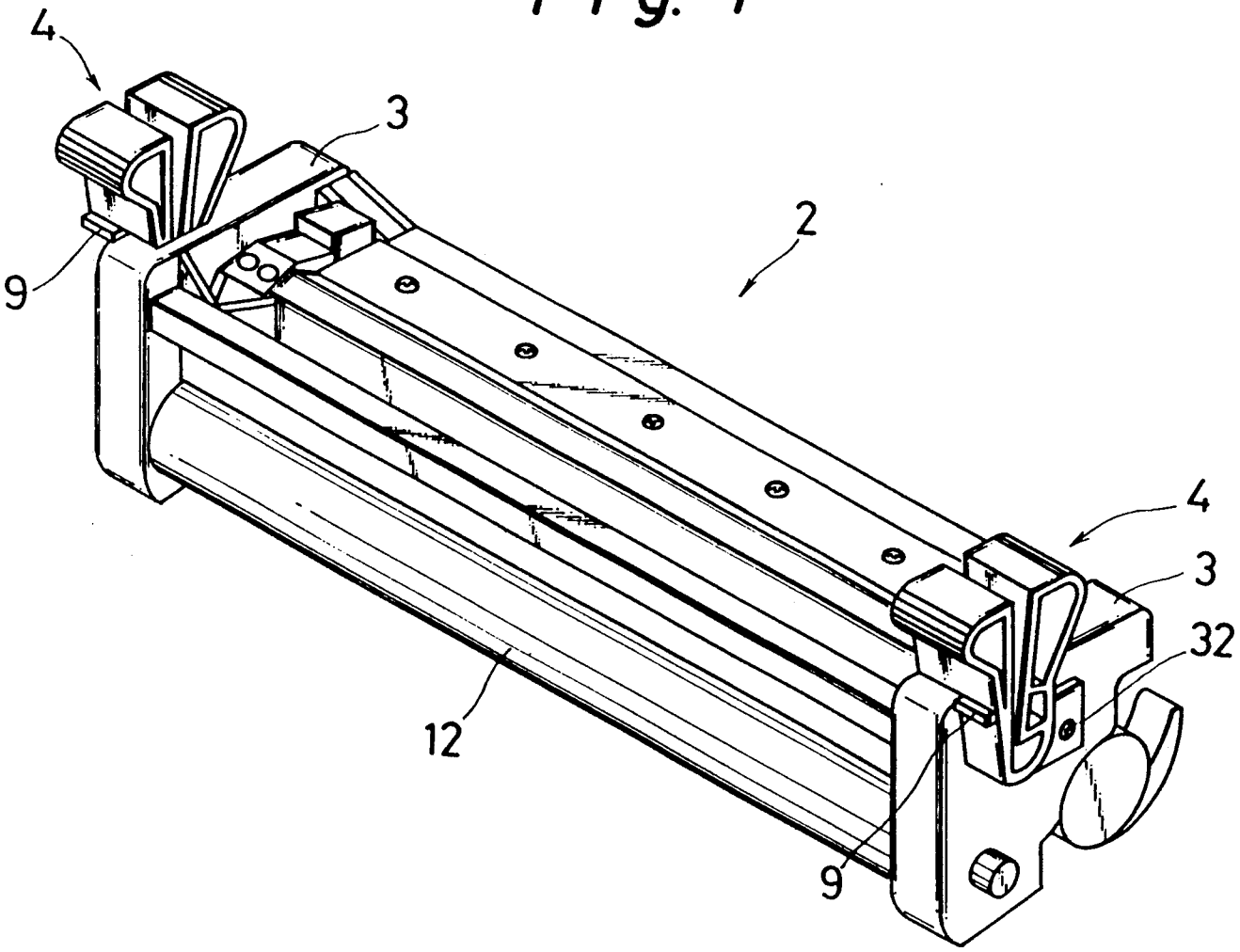
FIG. 1 is a perspective view of a process kit of laser printer shown as an embodiment of the invention.

Now referring to the drawing, preferred embodiments of the invention are described below.

Referring now to FIG. 1 through FIG. 12, an embodiment of the invention is described in detail below.

Figure 10:
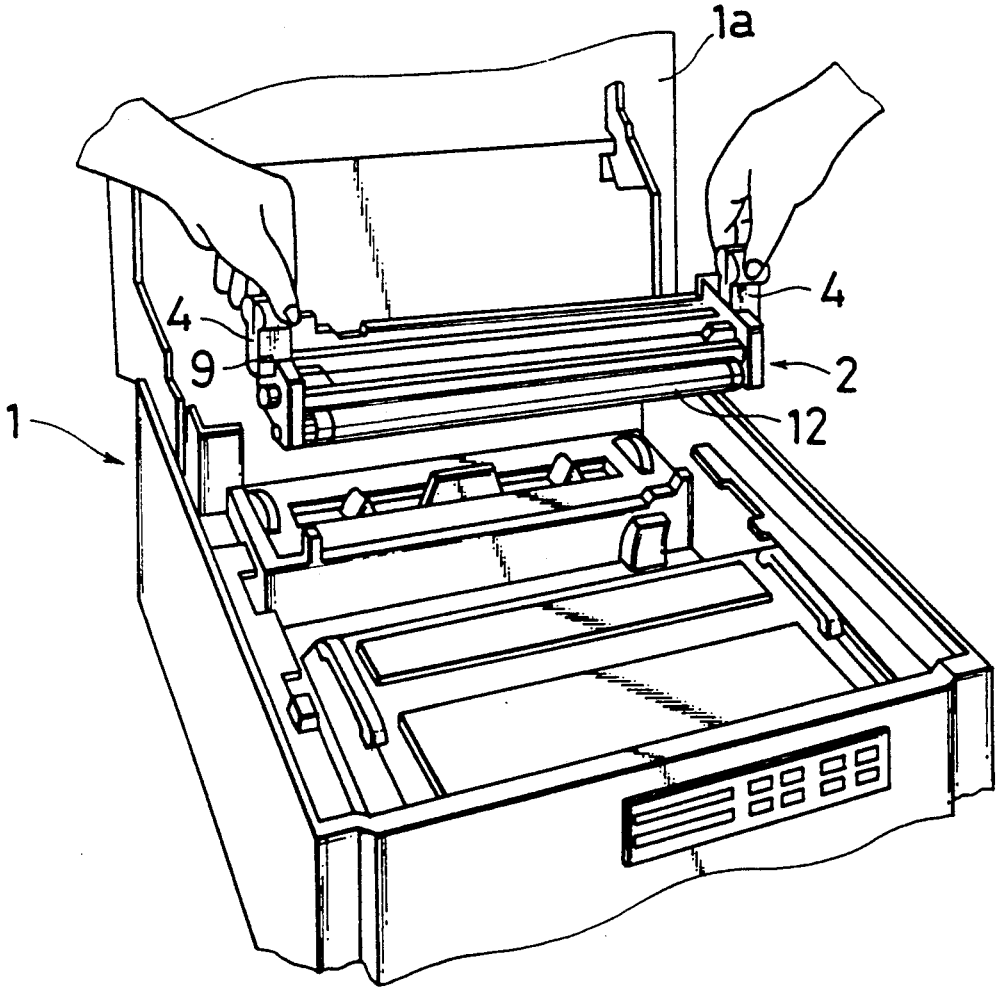
FIG. 10 is a schematic perspective view showing the detachable state of the process kit on the apparatus main body.

A laser printer of electrostatic transfer type as an image forming apparatus of the invention is composed as shown in FIG. 10, in which the upper part 1*a* of the apparatus main body 1 is formed free to open and close, and by opening the upper part 1*a* of the apparatus main body 1, the process kit 2 mentioned below is mounted and dismounted.

Figure 3:
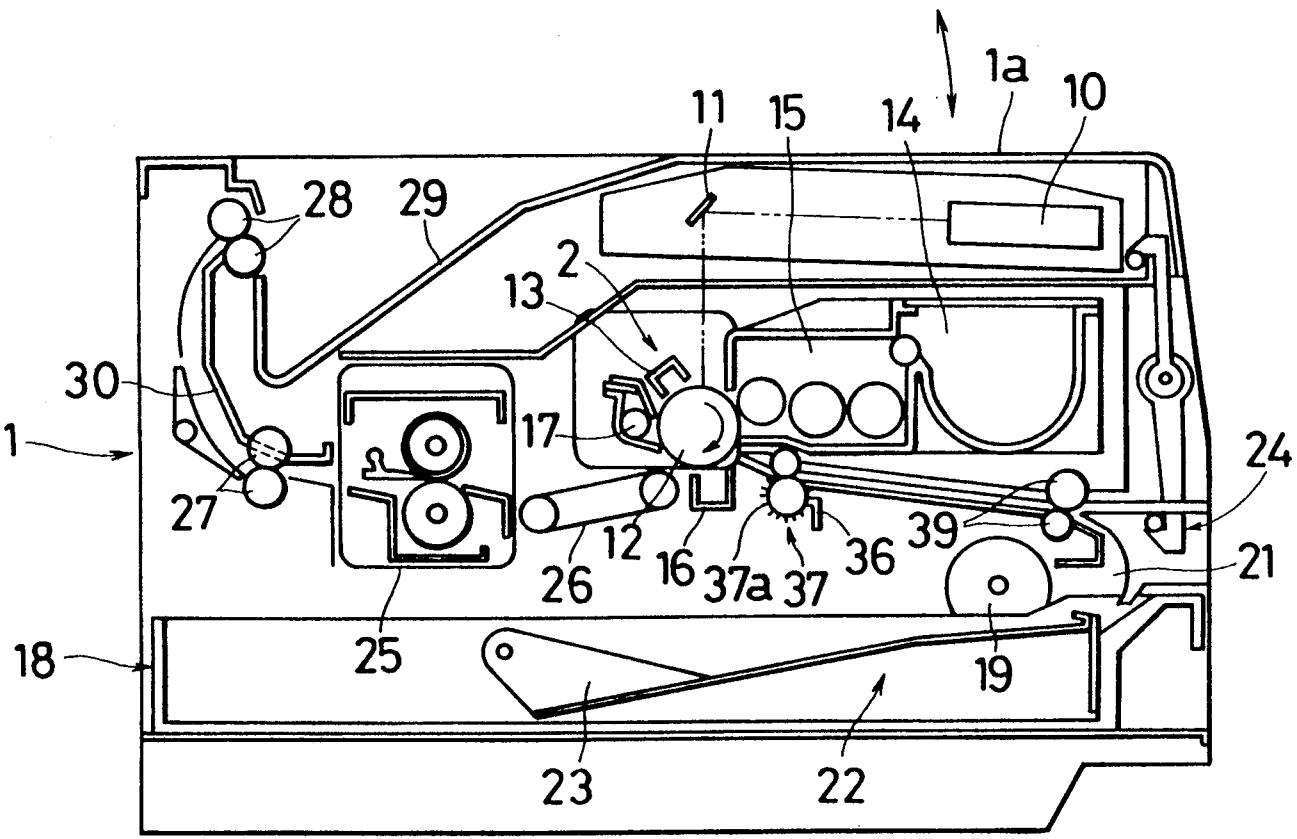
FIG. 3 is a schematic general view of the laser printer.

In the upper part 1*a* of the apparatus main body 1, as shown in FIG. 3, a semiconductor laser device 10 and a mirror 11 are disposed. The laser beam emitted from the semiconductor laser device 10 is reflected by the mirror 11 to irradiate a photosensitive drum 12 disposed beneath.

A photoconductive layer is formed on the surface of the semiconductor drum 12, which is driven by drum driving means not shown to rotate in the arrow direction in FIG. 3.

On circumference of the photosensitive drum 12, a main charger (corona discharger) 13, a developing unit 15 comprising a toner box 14, a transfer charger 16, and a cleaning unit 17 are disposed in this sequence.

In this embodiment, the photosensitive drum 12 as bar unit, the main charger 13, and the cleaning unit 17 are integrally supported by a support frame 3 (refer to FIG. 1) as bar unit supporting means, thereby composing the process kit 2.

The main charger 13 charges the surface of the photosensitive drum 12 to the specified potential. The developing unit 15 develops an electrostatic latent image formed on the surface of the photosensitive drum 12 by the toner supplied from the toner box 14. The transfer charger (corona discharger) 16 transfers the toner image formed on the surface of the photosensitive drum 12 on the paper supplied from a resist roller 37. The cleaning unit 17 removes and recovers the toner left over on the surface of the photosensitive drum 12 after transfer.

Beneath the photosensitive drum 12 is installed a paper cassette 18 for accommodating paper. The paper cassette 18 has a paper container 22, and this paper container 22 is provided with a paper hopper 23 for pushing the paper upward. Above the paper cassette 18, there is a pickup roller 19 for picking up the paper in the paper cassette 18 sheet by sheet and feeding in the paper conveying direction.

In the downstream side of the paper conveying direction to the pickup roller 19, a paper conveying route 21 which guides the paper fed by the picking roller 19 to a paper feed roller 39 disposed above the pickup roller 19. The paper feed roller 39 conveys a paper supplied from the paper cassette 18 or a manual paper feed part 24 to the resist roller 37.

At one peripheral end of the resist roller 37, plural bumps 37*a* are formed, and near the bumps 37*a* there is a roller stop solenoid possessing a hook 36 for stopping the rotation of the resist roller 37 by contacting with the bumps 37*a*. That is, the resist roller 37 is defined in the timing of rotation by the roller stop solenoid, and feeds the paper to the photosensitive drum 12 at the timing of transfer by the transfer charger 16.

In the downstream side of the paper conveying direction to the photosensitive drum 12, conveying means 26 for conveying the paper after transfer to a fixing unit 25, the fixing unit 25 for heating and fixing the toner image transferred on the paper, and a conveying roller 27 for conveying the paper after passing through the fixing unit 25 are disposed in this sequence. Further, above the conveying roller 27, a paper discharge roller 28 is disposed.

In the upper part 1*a* of the apparatus main body 1, a face down tray 29 is disposed at an inclination, and the paper conveyed by the conveying roller 27 is led upward by a conveying route 30, and is discharged outside of the machine by the paper discharge roller 28, and stacked up on the face down tray 29 with the printed surface of the paper faced down.

Here the process kit 12 is described in detail below.

Figure 2:
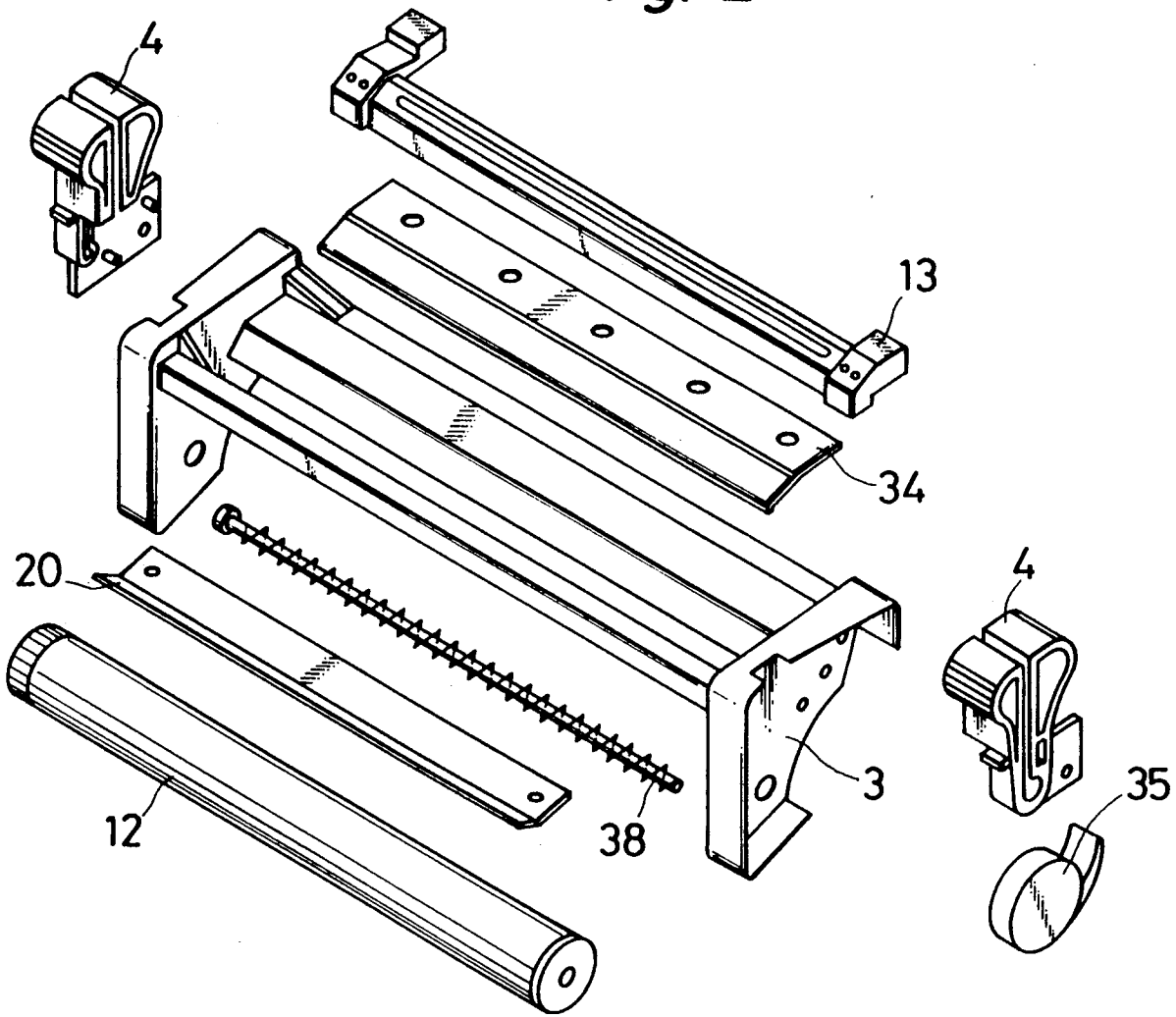
FIG. 2 is a perspective exploded view of the process kit.

As shown in FIG. 1 and FIG. 2, the photosensitive drum 12, main charger 13 and cleaning unit 17 (refer to FIG. 3) are supported horizontally in the longitudinal direction by the support frame 3. The photosensitive drum 12 is rotatably pivoted, and its surface is exposed outside. The support frame 3 is furnished with a toner receiving blade 20, a cleaning blade 34, a waste toner shutter 35 and a waste toner conveying shaft 38. The cleaning unit 17 is composed of the toner receiving blade 20, the cleaning blade 34 and the waste toner conveying shaft 38.

At both right and left ends of the support frame 3, handle members 4, 4 are provided. The handle members 4, 4 are provided at upper positions passing through the center of gravity of the process kit 2, and when lifted by gripping the handle members 4, 4, the process kit 2 is prevented from rotating to incline.

Figure 4:
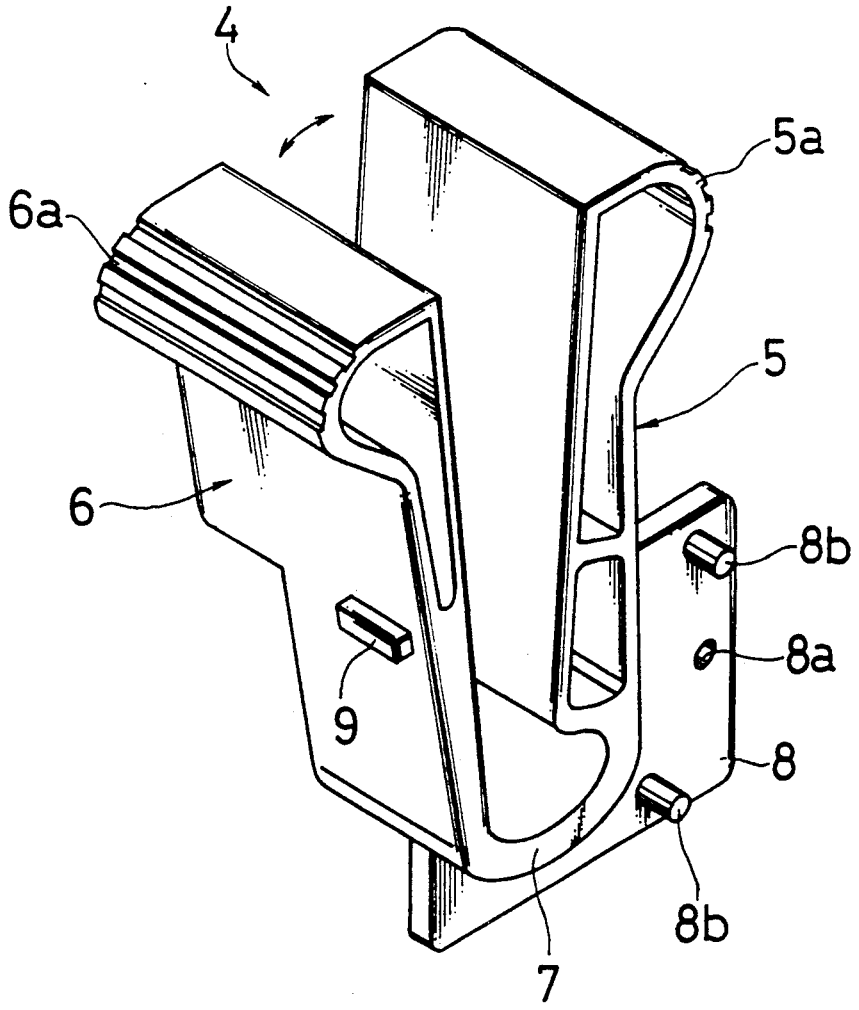
FIG. 4 is a perspective view showing a handle member of the process kit.

The handle member 4 has, as shown in FIG. 4, the lower ends of its fixed handle part 5 and movable handle part 6 confronting the fixed handle part 5 linked together by means of U-shaped rib 7, and a mounting part 8 is formed in the lower part of the fixed handle part 5, being formed in one body from a flexible resin or metal material.

Figure 5:
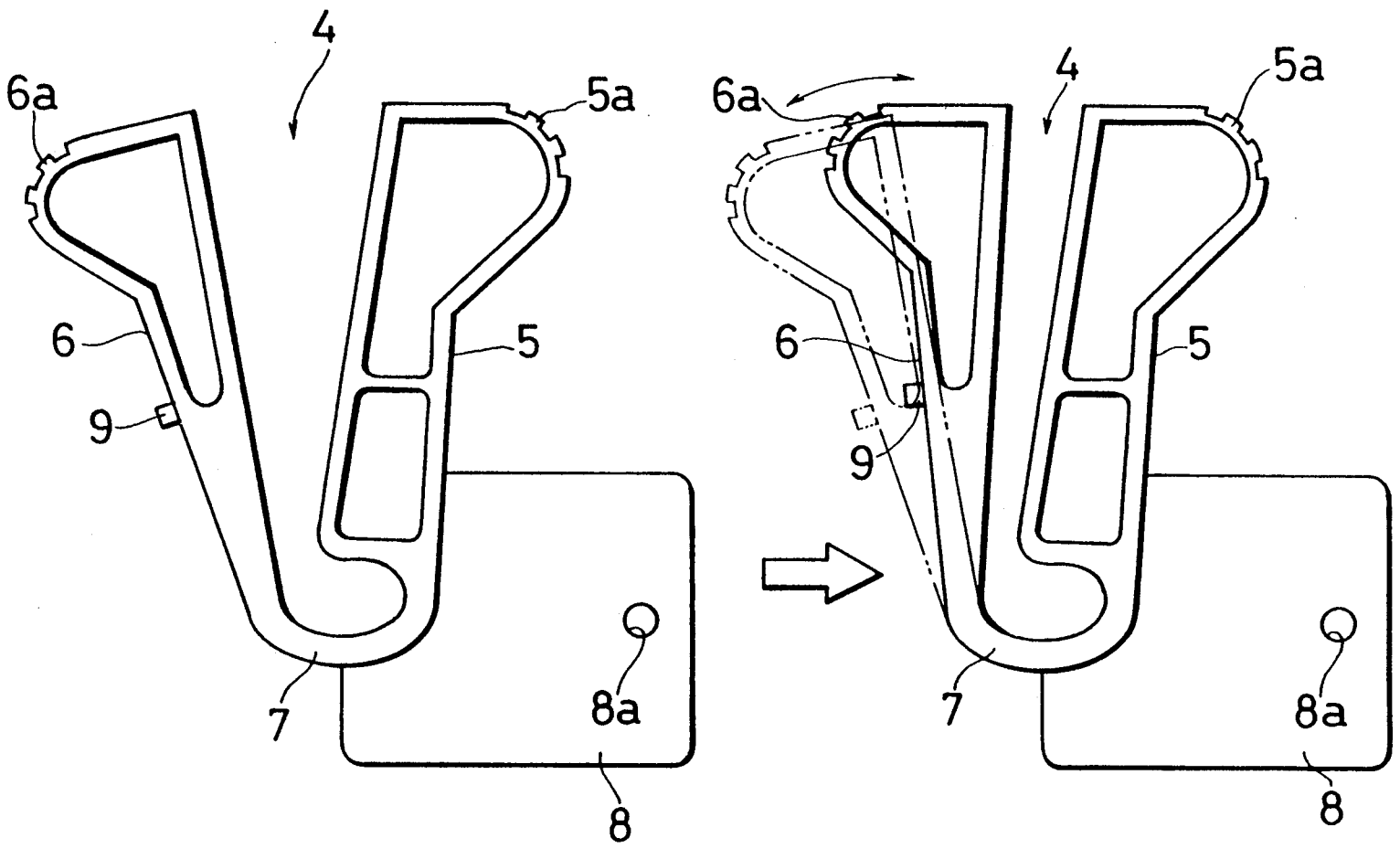
FIG. 5 is an explanatory diagram showing a movable state of a mounting handle part of the handle member.

At the upper ends of the fixed handle part 5 and movable handle part 6, handle parts 5*a*, 6*a* provided with anti-slip asperities are formed, and when gripped by applying fingers on the handle parts 5*a*, 6*a*, The U-shaped rib 7 is bent, as shown in FIG. 5, and the movable handle part 6 is dislocated in the direction of the fixed handle part 5, and when released from the fingers, the movable handle part 6 returns to the original position again.

Figure 6:
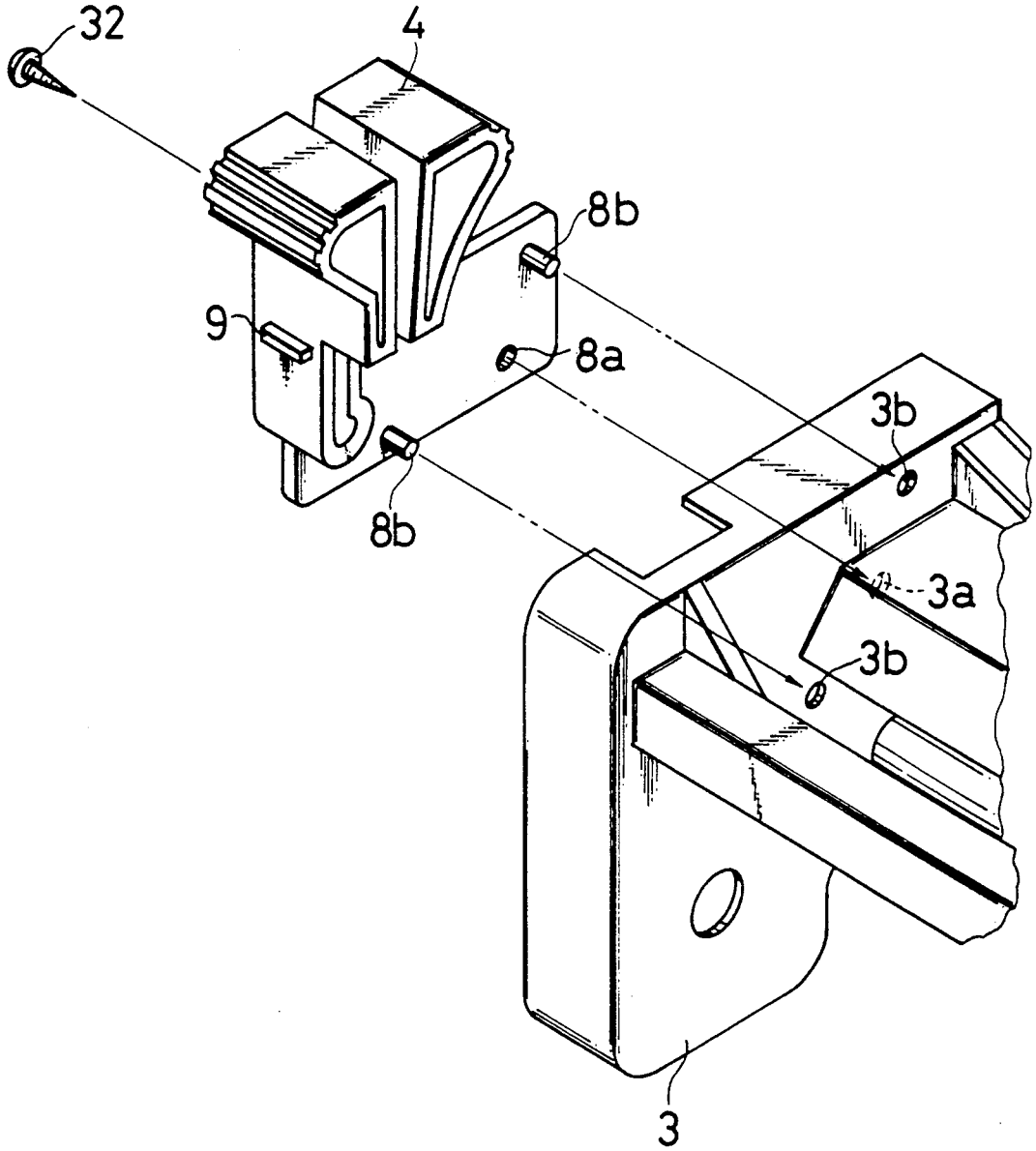
FIG. 6 is a perspective view showing the detachable structure of the handle member.
Figure 7:
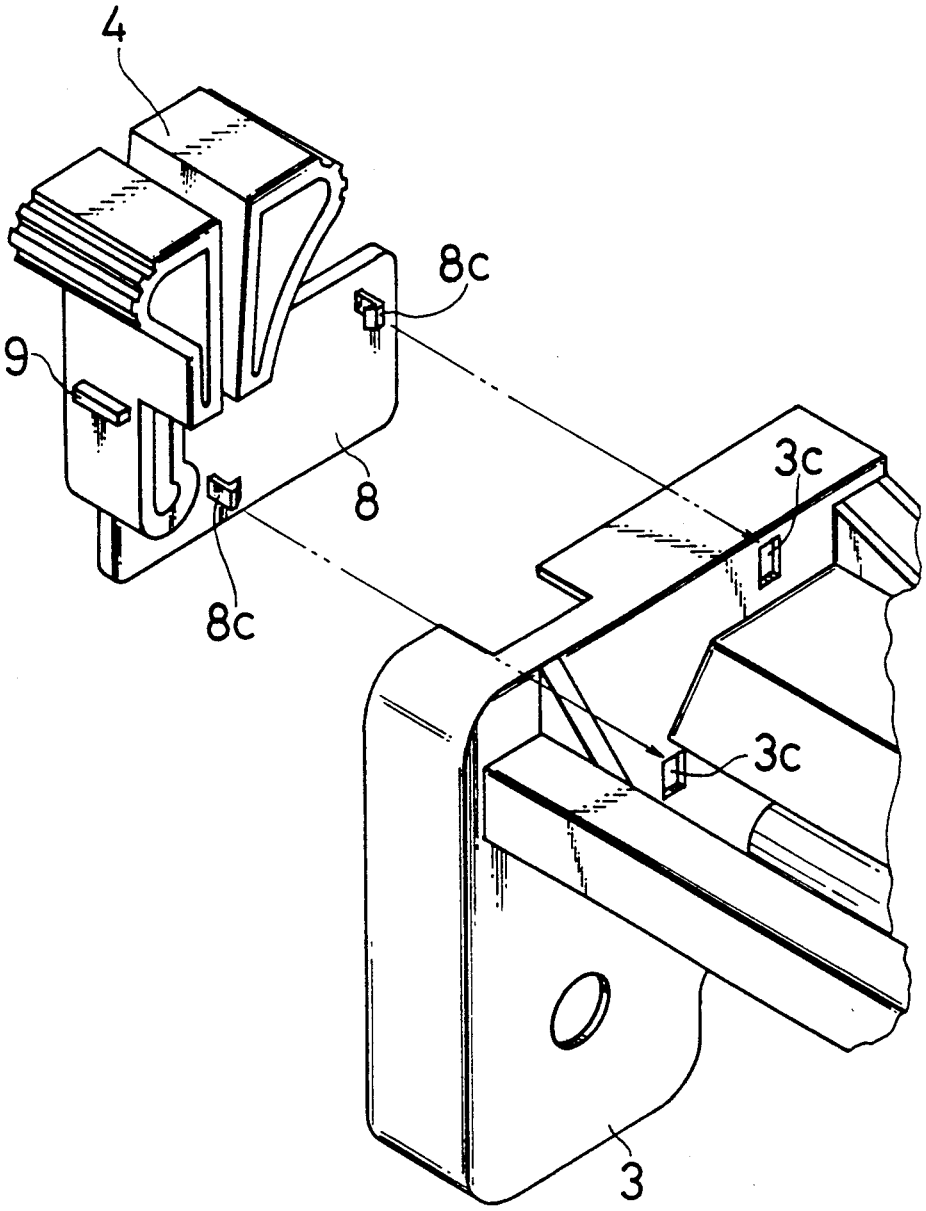
FIG. 7 is a perspective view showing another detachable structure of the handle member.

As shown in FIG. 6, a screw hole 8*a* and a boss 8*b* are formed in the mounting part 8, and a screw hole 3*a* and a boss hole 3*b* are formed in the support frame 3. The handle member 4 is fixed to the support frame 3 by a screw 32, and it can be easily dismounted from the support frame 3 by this screw 32. By inserting the boss 8*b* into the boss hole 3*b*, the support frame 3 is fixed without deviation. For mounting and dismounting the handle member 4 on and off the support frame 3, not limited to the screw 32, as shown in FIG. 7, a fixing pawl 8*c* may be formed in the mounting part 8, but a hole 3*c* to be fitted with the fixing pawl 8*c* may be formed in the support frame 3 side, which may be used as the mechanism for mounting and dismounting.

Beneath the handle part 6*a* in the movable part 6, a fixing pawl 9 is projected as the position fixing means for fixing the process kit 2 at the mounting position of the apparatus main body 1 by fitting with a fixing recess 31*b* provided at the apparatus main body 1 side as described later.

Figure 8:
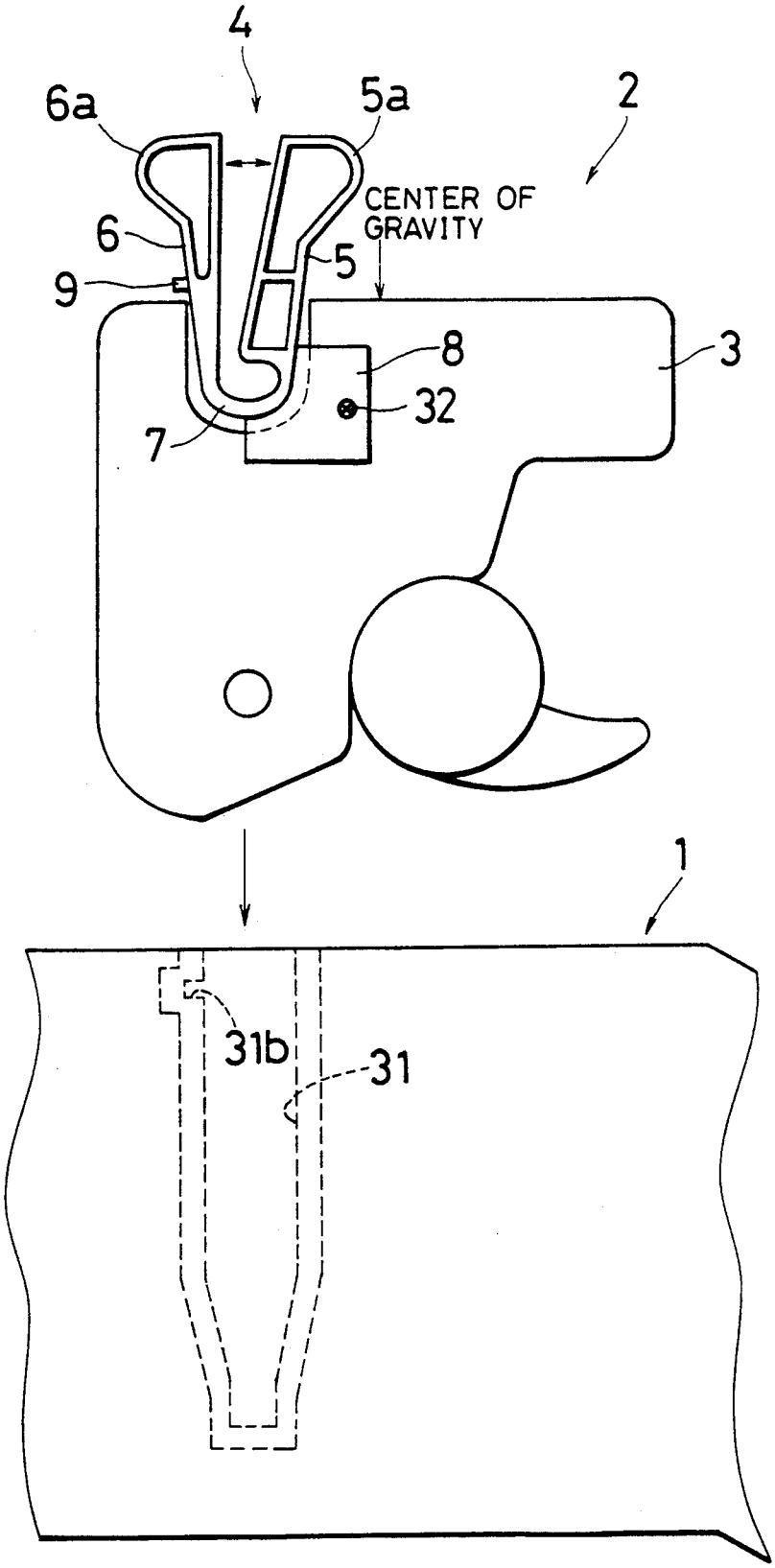
FIG. 8 is an explanatory diagram showing the state of mounting of the process kit on the apparatus main body.
Figure 9:
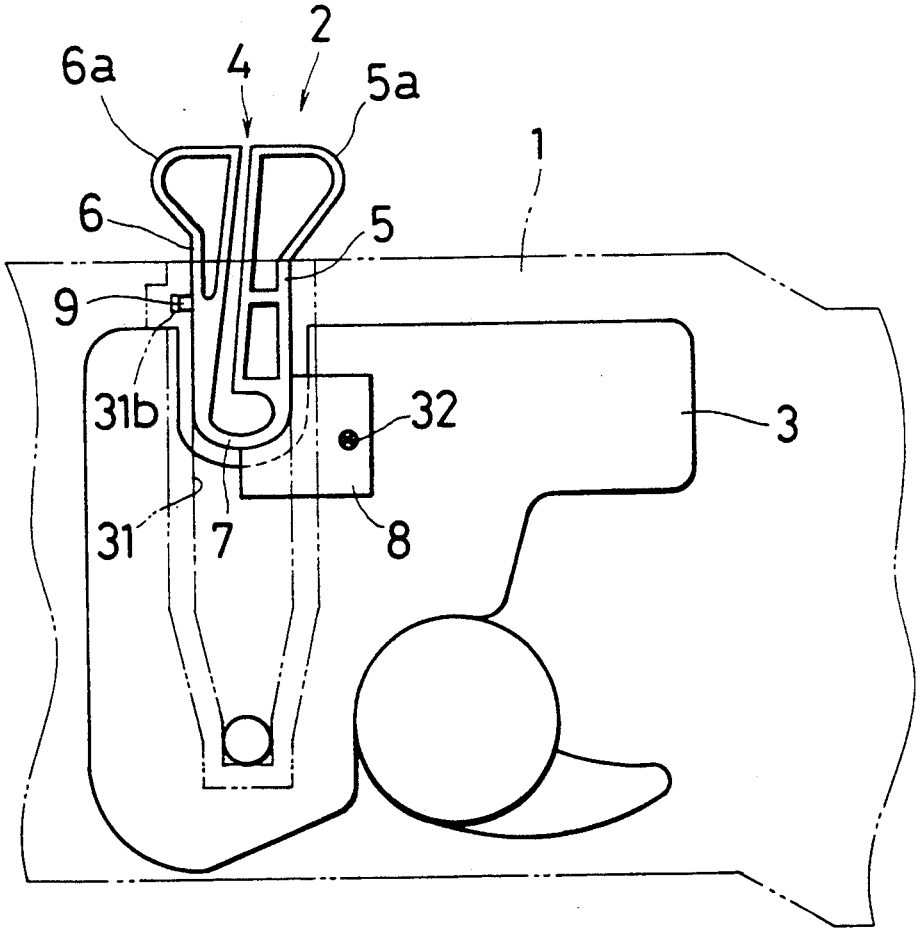
FIG. 9 is an explanatory diagram showing the state of the process kit being mounted on the apparatus main body.

The handle member 4 is disposed so as to project about half to the outside of the support frame 3. At the right and left side plates of the mounting position of the process kit 2 of the apparatus main body 1, as shown in FIG. 8 and FIG. 9, the projecting portion of the handle member 4 outside the support frame 3 is invading (at this time, the movable handle part 6 of the handle part 4 is dislocated to the fixed handle part 5, and the interval between the fixed handle part 5 and movable part 6 is less than the width of the guide groove 31), thereby forming a guide groove 31 for leading the process kit 2 to the mounting position. On the confronting side against the movable handle part 6 of the guide groove 31, there is a fixed recess 31*b* to be engaged with the fixed pawl 9 projecting on the movable handle part 6.

Figure 11:
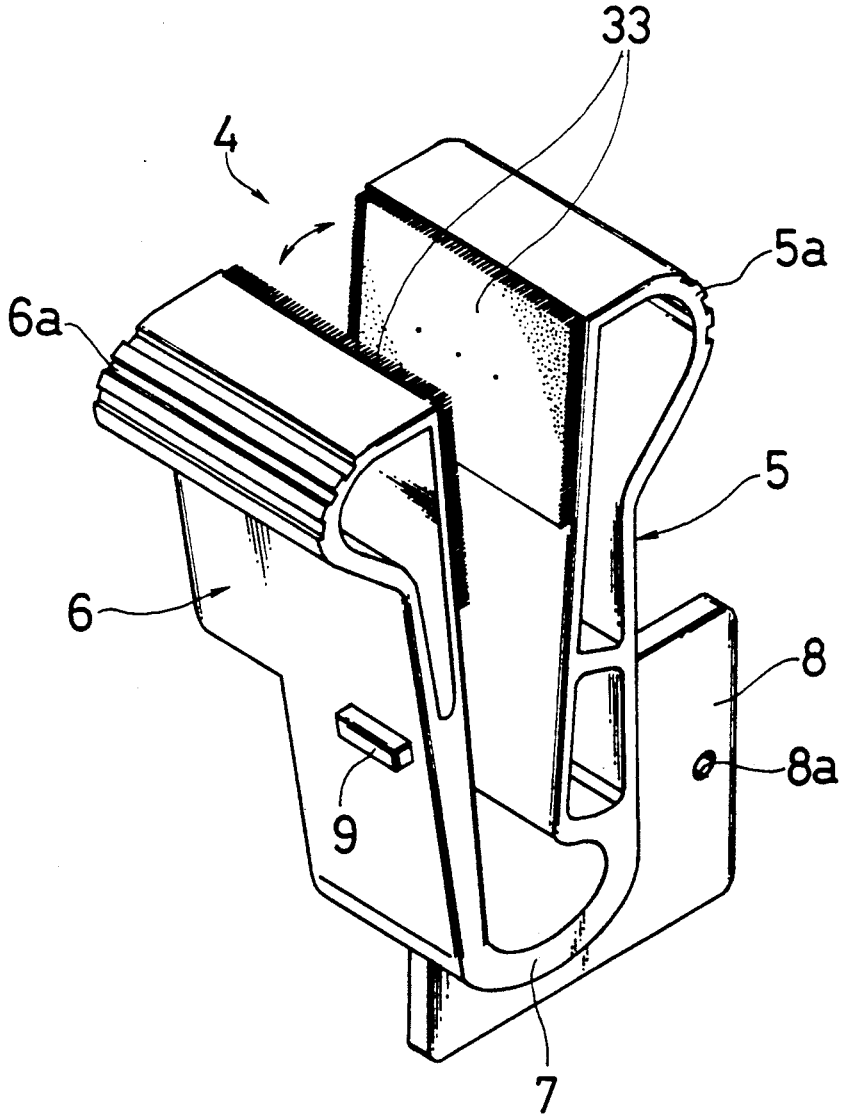
FIG. 11 is a perspective view showing an example of the state of installing the cleaning member in the handle member of the process kit.

Furthermore, in the handle member 4, as shown in FIG. 11, a cleaning member 33 for cleaning, for example, the wire of the corona discharger 13 are adhered to each confronting side (inside) of the fixed handle part 5 and the movable handle part 6, thereby forming the cleaning member 33 integrally. This cleaning member 33 is made of a relatively soft material, such as felt and sponge. In particular, the cleaning member 33 may be disposed on the handle members 4, 4 which are provided at both ends of the process kit 2, but may be disposed on at least one handle member 4. In this case, at least the handle member 4 on which the cleaning member 33 is disposed is installed detachably on the support frame 3.

In this constitution, the printing action in the laser printer is explained below.

In the printing action, as shown in FIG. 3, the surface of the photosensitive drum 12 is charged at a specific potential when confronting the main charger 13 along with the rotation of the photosensitive drum 12. On the other hand, from the semiconductor laser device 10, the laser beam in the quantity of light corresponding to the printing image is emitted, and this laser beam is reflected by the mirror 11, and is led onto the surface of the photosensitive drum 12 as indicated by single dot chain line in FIG. 3. As a result, only the exposed area of the surface of the photosensitive drum 12 is destaticized, and an electrostatic latent image corresponding to the printing image is formed on the surface of the photosensitive drum 12. This electrostatic latent image is developed as the toner deposits when confronting the developing unit 15.

On the other hand, the paper is sent out into a paper conveying route 21 from the paper cassette 18 through the pickup roller 19, and then conveyed to a resist roller 37 through a paper feed roller 39, or to the resist roller 37 from a manual paper feed part 24 through the paper feed roller 39. The paper is sent to the photosensitive drum 12 by the resist roller 37 at specified timing, and the toner image is transferred on the paper by the transfer charger 16. After transfer, the paper is conveyed to the fixing unit 25 through conveying means 26, and the toner image transferred by the fixing unit 25 is heated and fixed. Afterwards, the paper is conveyed the conveying roller 27, and is discharged into the face down tray 29 from the paper discharge roller 28 through the conveying route 30.

Explained below is the procedure for manipulation for mounting the process kit 2 on the apparatus main body 1 for replacement or other servicing.

First, as shown in FIG. 10, the upper part 1*a* of the apparatus main body 1*a* is opened. Then, the thumbs are applied on the handle parts 6*a* of the right and left handle members 4, 4 of the process kit 2, while the other fingers are applied on the handle parts 5*a* to grip (FIG. 4), and the process kit 2 is lifted while keeping balance with both hands, and is lowered on the mounting position of the apparatus main body 1 from above the open part of the apparatus main body 1.

Consequently, as shown in FIG. 8 and FIG. 9, it is positioned so that the projecting portion of the handle member 4 outside the support frame 3 may get into the guide groove 31 of the apparatus main body 1, and the process kit 2 is lowered until the fixed pawl 9 is fitted in the fixed recess 31*b*, so that the process kit 2 may be accurately installed in the mounting position. At this time, if a vertical force is applied to the process kit 2 without gripping the handle parts 5*a*, 6*a* of the handle members 4, 4, the process kit 2 is installed securely if the process kit 2 is not moved from that position. Finally, the opened upper part 1*a* of the apparatus main body 1 is closed.

To the contrary, when dismounting the process kit 2 from the apparatus main body 1, the operating procedure is as follows.

First, the upper part 1*a* of the apparatus main body 1 is opened. Then the fingers are applied to the handle parts 5*a*, 6*a* of the handle members 4, 4 to grip, and the U-shaped rib 7 is bent to displace the movable handle part 6 to the fixed handle part 5, thereby dislocating the fixed pawl 9 from the fixed recess 31*b*, and by straight lifting up the process kit 2 while keeping balance with both hands, so that the process kit 2 may be dismounted from the apparatus main body 1.

Thus, in the process kit 2, handle members 4, 4 are provided at both ends of the support frame 3, and when the user lifts the process kit 2, the handle members 4, 4 are held by both hands naturally. That is, the lifted process kit 2 is held at both ends, and is kept in balance by both hands, so that the support state of the process kit 2 may be always stable.

Therefore, whoever detaches and attaches the process kit 2, the process kit 2 is kept in good balance, and troubles of hitting the exposed photosensitive drum 12 against the members of the apparatus main body 1 side due to breakage of balance as experienced conventionally when mounting and dismounting the process kit 2 may be decreased as small as possible.

Moreover, the fixed pawl 9 is provided in the handle member 4 of the process kit 2, and therefore even the user without professional knowledge can judge easily whether the process kit 2 has been installed securely at the specified mounting position or not. It is hence possible to avoid the trouble of damage of the photosensitive drum 12 as the upper part 1*a* of the apparatus main body 1 is closed without knowing that the process kit 2 has been installed off the specified mounting position as experienced conventionally.

Since the fixed pawl 9 is provided in the handle member 4 as the position fixing means, it is enough to grip the handle member 4 to mount or dismount the process kit 2, and complicated procedure is not required at all.

Figure 12:
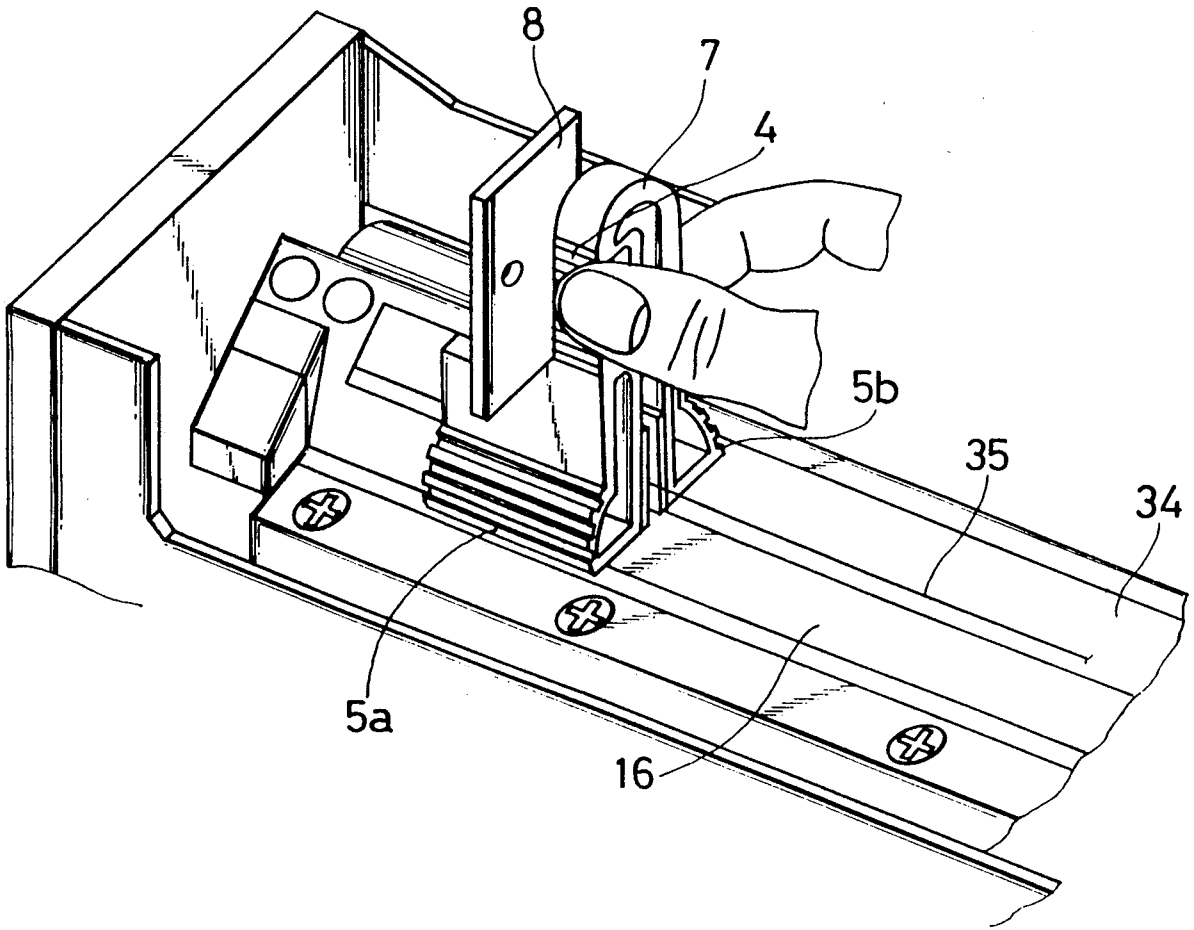
FIG. 12 is a perspective view showing the cleaning state of the corona discharger by the handle member.

When dismounting the process kit 2 for maintenance or the like to clean the wire of the corona discharger, as explained above, first the process kit 2 is dismounted from the apparatus main body. Then the handle member 4 possessing the cleaning member 33 is detached off the process kit 2. The dismounted handle member 4 is, as shown in FIG. 12, pressed near the U-shaped rib 7 so as to pinch the wire 35 with the cleaning member 33 by inserting the handle parts 5*a*, 6*a* of the handle member 4 inside the charger from the opening 34 of the corona discharger (main charger 13 and transfer charger 16). As a result, the wire 35 is pinched by the cleaning member 33, and the handle member 4 is moved right and left in this state by the wire 35 to clean.

When cleaning of the corona discharger is thus over, after other maintenance or servicing, the handle member 4 is mounted on the process kit 2 in the reverse procedure, and the process kit 2 is installed in the image forming apparatus main body 1.

In this laser printer, in this way, any user without professional knowledge can easily and accurately install the process kit 2.

In this embodiment, meanwhile, the photosensitive drum 12, main character 13, and cleaning unit 17 are supported integrally as the bar unit by the support frame 3 to compose the process kit 2, but the bar unit is not limited to this alone, and it may be, for example, a developing unit or paper conveying roller. Likewise, the number of units to be supported integrally by the support frame 3 is not limited at all.

For example, when the developing unit 15 possessing a toner box 14 is installed in the process kit 2 as a bar unit, if the process kit 2 is lifted, the toner box 14 is kept horizontal, and the toner in the toner box 14 is not shifted to one side, and partial failure in development due to shift of the toner after installation of the process kit 2 may be avoided.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which comes within the meaning and the range of equivalency of the claims are therefore intended to be embraced therein.

What is claimed is:

1. A process kit of image forming apparatus comprising a bar unit for composing an image forming apparatus, bar unit supporting means for supporting the bar unit horizontally in the longitudinal direction, and a handle member disposed in the bar unit supporting means, so that the process kit may be mounted from above the image forming apparatus main body, wherein the handle member is provided at both ends of the bar unit supporting means, and position fixing means for fixing the process kit in the specified mounting position of the image forming apparatus main body is provided in the handle member.

2. The process kit of image forming apparatus as claimed in claim 1, wherein at least one of the handle member is detachably on and off the bar unit supporting means, and a cleaning member is provided in the handle member.

3. The process kit of image forming apparatus as claimed in claim 2, wherein the handle member comprising a fixed handle part and a movable handle part opposite to the fixed handle part, and the cleaning member is provided on the mutually opposing surfaces of the fixed handle part and movable handle part.

4. The process kit of image forming apparatus as claimed in claim 2, wherein the handle member has a pawl part, and a hole to be fitted with the pawl part is provided in the bar unit supporting means.

5. The process kit of image forming apparatus as claimed in claim 4, wherein a boss is formed in the handle member, and a boss hole in which the boss is inserted is formed in the bar unit supporting means.

6. The process kit of image forming apparatus as claimed in claim 2, wherein the cleaning member is composed of a material possessing relatively a flexibility.

7. The process kit of image forming apparatus as claimed in claim 2, wherein the cleaning member is composed of felt.

8. The process kit of image forming apparatus as claimed in claim 2, wherein the cleaning member is composed of sponge.

* * * * *